US005207157A

United States Patent [19]

Okazaki et al.

[11] Patent Number: 5,207,157

[45] Date of Patent: May 4, 1993

[54] CONTROL DEVICE FOR A STENCIL DUPLICATING MACHINE

[75] Inventors: Masanobu Okazaki, Murata; Kazuyuki Suzuki, Natori, both of Japan

[73] Assignee: Ricoh Company, Ltd., Tokyo, Japan

[21] Appl. No.: 924,513

[22] Filed: Aug. 4, 1992

Related U.S. Application Data

[62] Division of Ser. No. 633,222, Dec. 21, 1990, abandoned.

[30] Foreign Application Priority Data

Dec. 22, 1989 [JP] Japan ..... 1-331151
Dec. 25, 1989 [JP] Japan ..... 1-332850

[51] Int. Cl.[5] ..... B41C 1/14; B41L 13/06

[52] U.S. Cl. ..... 101/116; 101/128.4

[58] Field of Search ..... 101/128.4, 128.21, 129, 101/116, 117, 118, 119, 120; 355/311

[56] References Cited

U.S. PATENT DOCUMENTS 4,366,219 12/1982 Beery ..... 355/311 X
4,505,579 3/1985 Furuichi ..... 355/311 X
4,585,332 4/1986 Shency ..... 355/311 X
4,603,962 8/1986 Dekura ..... 355/311

FOREIGN PATENT DOCUMENTS 1150103 6/1963 Fed. Rep. of Germany .
5284 1/1983 Japan .
0279979 12/1987 Japan ..... 101/116
0224987 9/1988 Japan ..... 101/116
2208279 3/1989 United Kingdom ..... 101/118

*Primary Examiner*—Clifford D. Crowder
*Attorney, Agent, or Firm*—Oblon, Spivak, McClelland, Maier & Neustadt

[57] ABSTRACT

A control device for a stencil duplicating machine having a stencil or master making section, printing section, paper feeding section and discharging section in an integrated assembly. Whether or not a master sheet is wrapped around a drum included in the printing section is determined to execute adequate processes stably at all times. During a master making process, whether or not a used master sheet is on the drum is detected. If one is present, a discharge command is issued. If one is not present a master is made and placed on the drum. During a printing process, whether or not a new master sheet is on the drum is detected. If one is present, printing is executed. If one is not present, printing is inhibited.

2 Claims, 10 Drawing Sheets

CONTROL DEVICE FOR A STENCIL DUPLICATING MACHINE

This is a division of application Ser. No. 07/633,222, filed on Dec. 21, 1990, abandoned.

BACKGROUND OF THE INVENTION

The present invention relates to a control device for a stencil duplicating machine of the type having a stencil or master making section, printing section, paper feeding section and discharging section in an integrated assembly.

A stencil duplicating machine of the type described is extensively used since it is cost-effective in printing a document image on a great number of paper sheets. A stencil or master making section forms cuts in a master sheet in a pattern corresponding to a document image. The master sheet is then wrapped around a drum included in a printing section. While the drum is in rotation, a paper sheet fed from a paper feeding section is pressed against the master sheet by a press roller. As a result, ink is fed from the inside of the drum to the master sheet and further to the paper sheet through the cuts of the master sheet, printing out the document image on the paper sheet. The used master sheet is driven out to a discharging section, and then a new master sheet is wrapped around the drum to execute the above-mentioned iterative sequence of steps. The prerequisite is that the used master be surely discharged and the new master sheet be surely wrapped around the drum.

The problem with a conventional integrated stencil duplicating machine is that it lacks the function of determining whether or not a master sheet is present on the drum. Specifically, it is likely that the operation for discharging a used master sheet occurs in the master making process despite that the used master sheet has already been removed from the drum and discharged. Conversely, when the used master sheet remains on the drum even after the discharging operation due to some error, it cannot be detected and, hence, a master making operation occurs immediately after the discharging operation. Then, the resulted new master sheet wraps around the used master sheet existing on the drum, so that the latter prevents ink from the drum from reaching the former. Further, when the printing operation begins before a new master sheet is positioned on the drum, a paper sheet fed from the paper feeding section sticks to the drum due to the ink supplied from the drum surface and remains on the drum without being discharged. Then, the operator has to pull out the drum from the machine body and then remove the paper sheet from the drum. This not only wastes the paper sheet smeared all over by the ink but also causes the operator's hand and cloths to be stained. In addition, when the paper sheet sticks to the drum, a new master sheet produced by the next master making process will wrap around the paper sheet and, therefore, will not be supplied with the ink from the drum.

In the above-described type of machine, the image area of a master sheet in which an image pattern is to be formed is determined by the size of a document or the magnification change ratio thereof. More specifically, the image area as measured in an intended direction of paper transport, i.e., in the rotating direction of the drum depends on the document size or the magnification-changed image size. Assume that the paper sheets stacked in the paper feeding section are of the size smaller than the document size or the magnification-changed image size, and that each paper sheet is fed out in such a manner as to coincide at the leading edge thereof with the leading edge of the image area of the master sheet. Then, the image area will partly protrude from the paper sheet in a trailing edge portion thereof and will therefore be printed on the press roller to smear it. The smeared press roller in turn smears the back of paper sheets which are sequentially fed from the paper feeding section.

SUMMARY OF THE INVENTION

It is therefore a first object of the present invention to provide a control device for an integrated stencil duplicating machine which insures stable processes at all times by determining whether or not a master sheet is present on a drum.

It is a second object of the present invention to provide a control device for an integrated stencil duplicating machine which frees a press roller and and the back of paper sheets from smears ascribable to the part of an image area of a master sheet protruding from a paper sheet.

In a stencil duplicating machine for selectively executing, in response to a command entered on an operating section, a master making process in which a used master sheet wrapped around a drum in a printing section is removed and discharged by a discharging section and then a new master sheet produced by a master making section is wrapped around the drum, and a printing process in which the printing section prints out an image formed in the new master sheet wrapped around the drum on a paper sheet fed from a paper feeding section, a control device of the present invention comprises a master sheet detecting section for determining whether or not the used master sheet or the new master sheet is present in the drum, and a control section for controlling, in response to the command entered on the operating section, the printing section, discharging section, master making section and paper feeding section such that when the master sheet detecting section detects the new master sheet on the drum, the master making process and printing process are executed while, when the master sheet detecting section does not detect the master sheet, the master making process and printing process are inhibited.

Also, in a stencil duplicating machine comprising a master making section having a head for forming a document image in a master sheet on the basis of a size of a document or a size of a magnification-changed image size, a printing section having a drum for wrapping the master sheet therearound and a press roller for pressing the master sheet against the drum to supply ink from the inside of the drum to the master sheet, and a paper feeding section for feeding paper sheets one by one between the drum and the press roller, a control device of the present invention comprises a paper size detecting section for detecting a size of the paper sheets loaded in the paper feeding section, and a control section for controlling the master making section such that an image is not formed in the master sheet except for an image area of the master sheet which is associated with the size of the paper sheets detected by the paper size detecting section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the present invention will be described with reference to the accompanying drawings.

First Embodiment

A first embodiment which will be described is directed toward the previously stated first object of the present invention.

Figure 1:
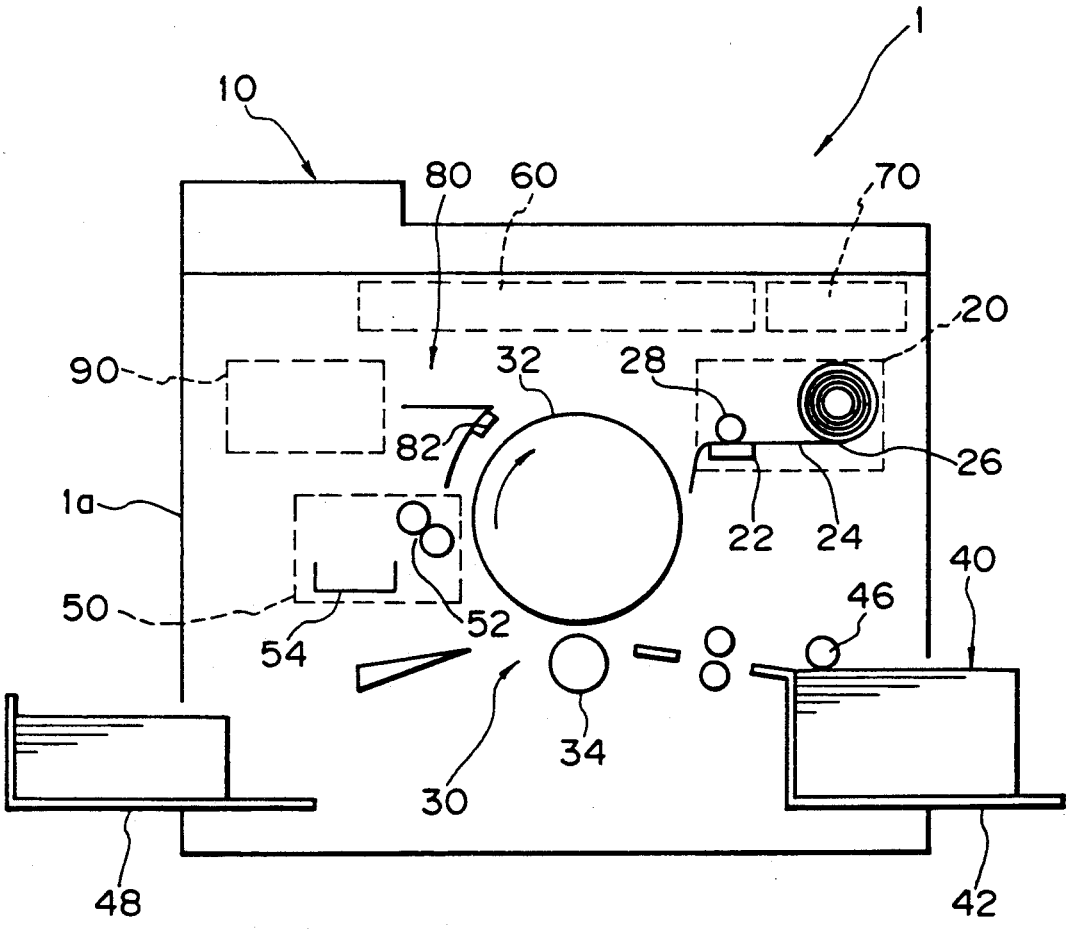
FIG. 1 is a view showing a stencil duplicating machine implemented with a first embodiment of the present invention.

Referring to FIG. 1, an integrated stencil duplicating machine implemented with the illustrative embodiment is shown and includes a document reading section 10. The document reading section 10 optically reads a document laid on a platen by hand or by ADF (Automatic Document Feeder), thereby producing an electric image signal. The image signal is fed to a stencil or master making section 20 which has a thermal head 22 and a platen roller 28. In response, the master making section 20 makes a stencil or master by using a master sheet 24 which is paid out from a roll 26 and cut in a predetermined size. A printing section 30 has a drum 32 and a press roller 34 pressing against the drum 32. The master sheet 24 driven out the master making section 20 is wrapped around the drum 32. A paper feeding section 40 has a tray 42 loaded with a stack of paper sheets 44 and a pick-up roller pair 46. The paper sheets 44 are fed one by one between the master sheet 24 wrapped around the drum 32 and the press roller 34. A discharging section 50 has a roller pair 52 and a tray 54 for discharging the master sheet 24 undergone the printing procedure, or used master sheet. An operating section 60 is provided on a control panel and accessible for operating the duplicating machine 1. A display section 70 is also provided on the control panel. A master sheet detecting section 80 determines whether or not the master sheet 24 is present on the drum 32. A control section 90 controls the operations of such various sections 10, 20, 30, 40, 50, 60, 70 and 80. The paper sheets 44 carrying images thereon, or duplicates, are stacked on a tray 48.

Figure 2:
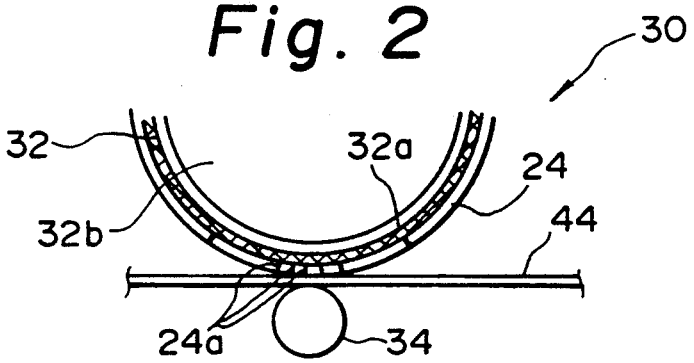
FIG. 2 is a section showing a drum and a press roller included in a printing section of the machine.
Figure 3:
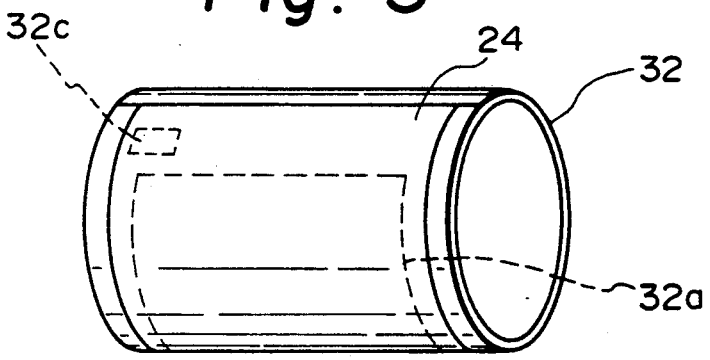
FIG. 3 is an external perspective view of the drum loaded with a master sheet.
Figure 4:
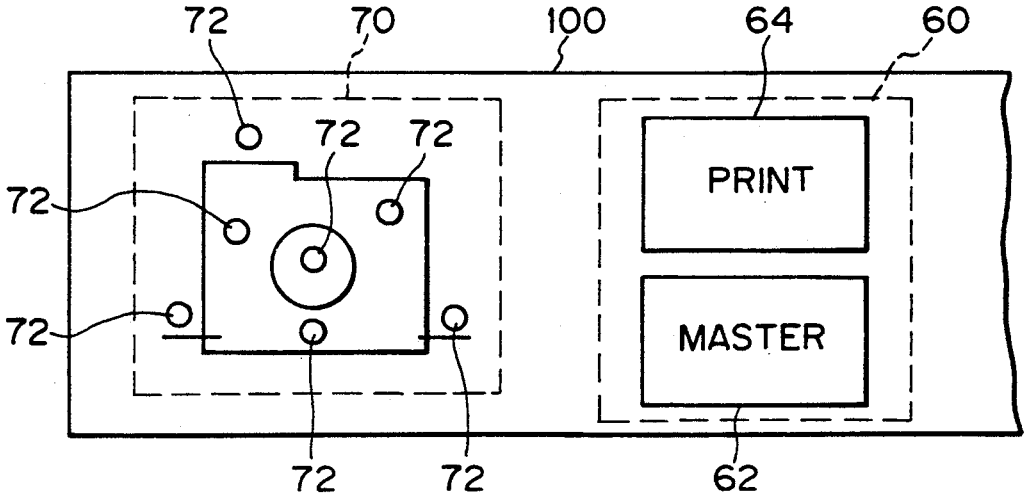
FIG. 4 is a plan view of a control panel of the machine and provided with an operating section and a display section.
Figure 5:
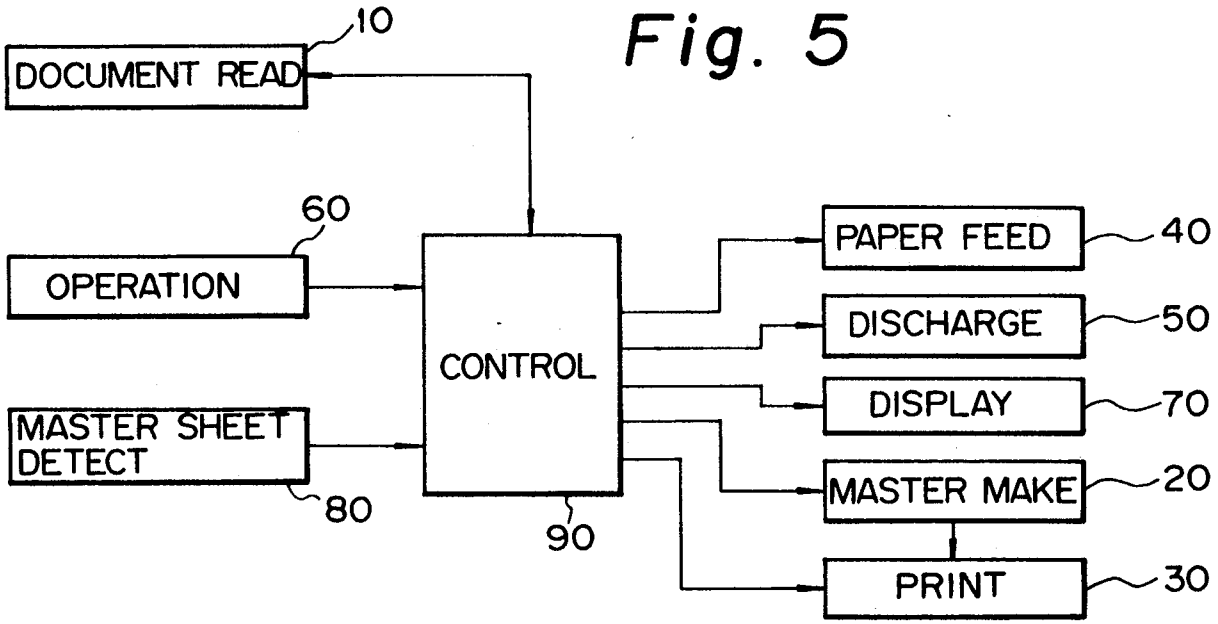
FIG. 5 is a block diagram showing the construction of first embodiment.

As shown in FIG. 2, a meshed screen 32*a* is provided on the surface of the drum 32 over a predetermined area. While the master sheet 24 formed with a number of cuts 24*a* representative of the document image is positioned on the screen 32*a*, ink 32*b* stored in the drum 32 is fed through the screen 32*a* to the master sheet 24. As a result, the ink 32*b* is applied to the paper sheet 44 through the cuts 24*a* to reproduce the document image on the paper sheet 44. As shown in FIG. 3, the drum 32 has a light absorbing portion 32*c* in a predetermined position lying in an area where the screen 32*a* is absent and where the master sheet 24 is expected to exist. The master sheet detecting section 80, FIG. 1, is so located as to face the light absorbing portion 32*c* and is implemented as, for example, a reflection type photosensor made up of a light emitting element and a light-sensitive element. As shown in FIG. 4, a panel 100 having the operating section 60 and display section thereon has a master start key 62 and a print start key 64. The display section 70 has LEDs (light emitting diodes) or similar indicators 72 for indicating errors, for example, which may occur in the various sections of the machine 1. The control section 90 is connected to the sections 10, 20, 30, 40, 50, 70, 70 and 80, as shown in FIG. 5.

In operation, as the operator presses the master start key 62 first, the machine 1 removes a used master sheet 24 from the drum 32 and drives it out to the discharging section 50 by a conventional operation. Then, the machine 1 executes a master making process. Specifically, while the document reading section 10 feeds an image signal representative of a document to the master making section 20, the section 20 drives the thermal head 22 to write the document image in a fresh master sheet 24, i.e., to form cuts 24*a* representative of the document image in the master sheet 24. Then, the master sheet 24 is wrapped around the drum 32. Thereupon, as the operator presses the print start key 64, the machine 1 enters into a printing process. In this process, a paper sheet 44 fed from the paper feeding section 40 is pressed against the drum 32 by the press roller 34 with the intermediary of the master sheet 24 at a predetermined pressing position. At the pressing position, the ink 32*b* is fed to the paper sheet 44 through the screen 32*a* and the cuts 24*a* of the master sheet 24, whereby an image associated with the document is printed on the paper sheet 44. Then, the paper sheet or duplicate 44 is transported to the tray 48.

Figure 6:
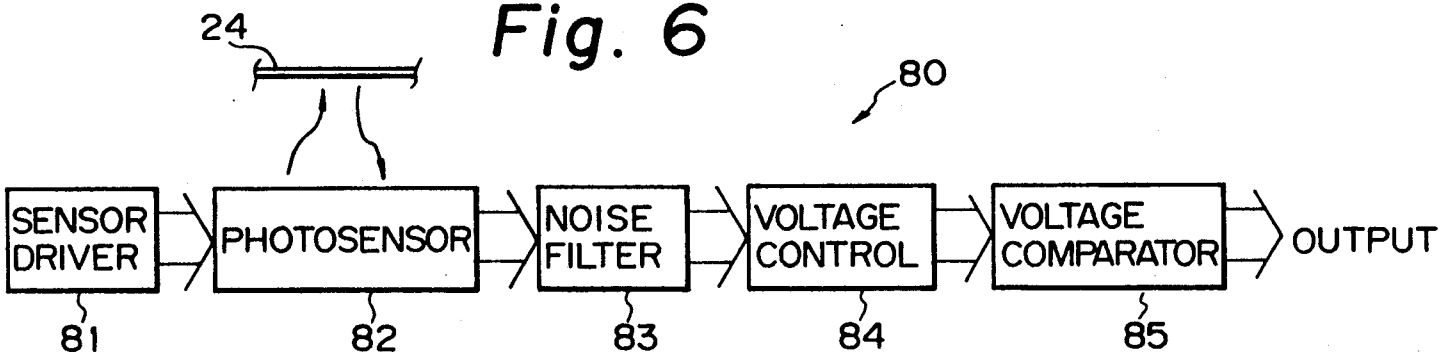
FIG. 6 is a block diagram showing a specific construction of a master sheet detecting section included in the embodiment.

Assume that the master sheet 24 is wrapped around the drum 32, as shown in FIG. 3. Then, light issuing from the master sheet detecting section 80, i.e., the light emitting element of a photosensor toward the light absorbing portion 32*c* of the drum 32 is reflected by the master sheet 24 and incident to the associated light-sensitive element. As a result, the detecting section 80 determines that a master sheet 24 is present on the drum 32. On the other hand, when a master sheet 24 is absent on the drum 32, the light is absorbed by the light absorbing portion 32*c* and not returned to the light-sensitive element. Then, the detecting section 80 determines that a master sheet 24 is absent on the drum 32. FIG. 6 shows a specific construction of the detecting section 80. As shown, a sensor driver 81 is connected to a photosensor 82 for constantly energizing a light emitting element included in the photosensor 82 together with a light-sensitive element. The photosensor 82 feeds a voltage signal associated with light incident to the light-sensitive element to a noise filter 83. The output of the noise filter 83, i.e., the voltage signal without noise is applied to a voltage amplifier 84. A voltage comparator 85 compares the output of the voltage amplifier 84 with a reference voltage and, if the former is higher than the latter, produces a detection output determining that a sufficient amount of light is incident to the light-sensitive element. While the photosensor 82 is located to face the light absorbing portion 32*c* of the drum 32. FIG. 1, the sensor driver 81, noise filter 83, voltage amplifier 84 and voltage comparator 85 are built in the control section 90.

Figure 7:
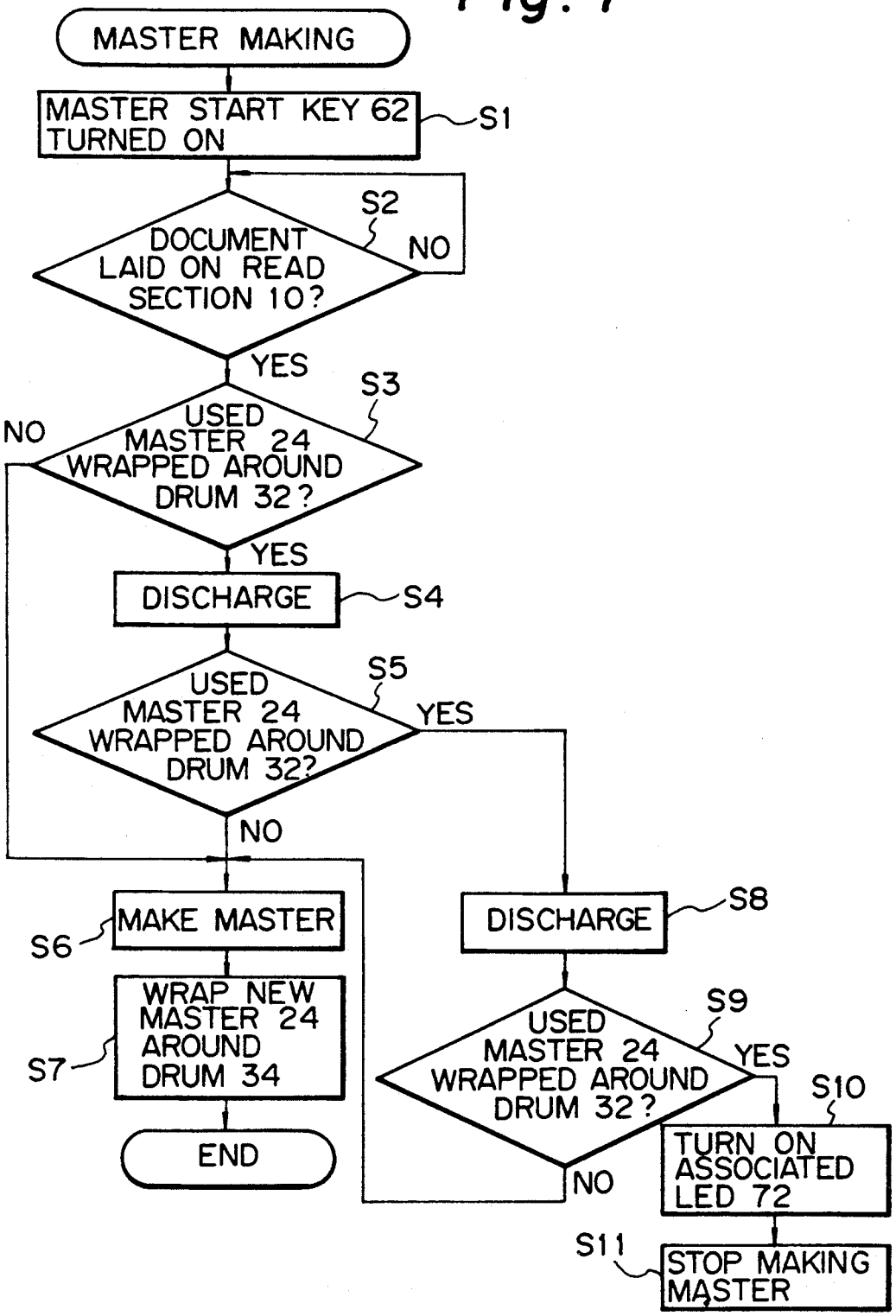
FIG. 7 is a flowchart demonstrating a specific master making process executed by the embodiment.
Figure 8:
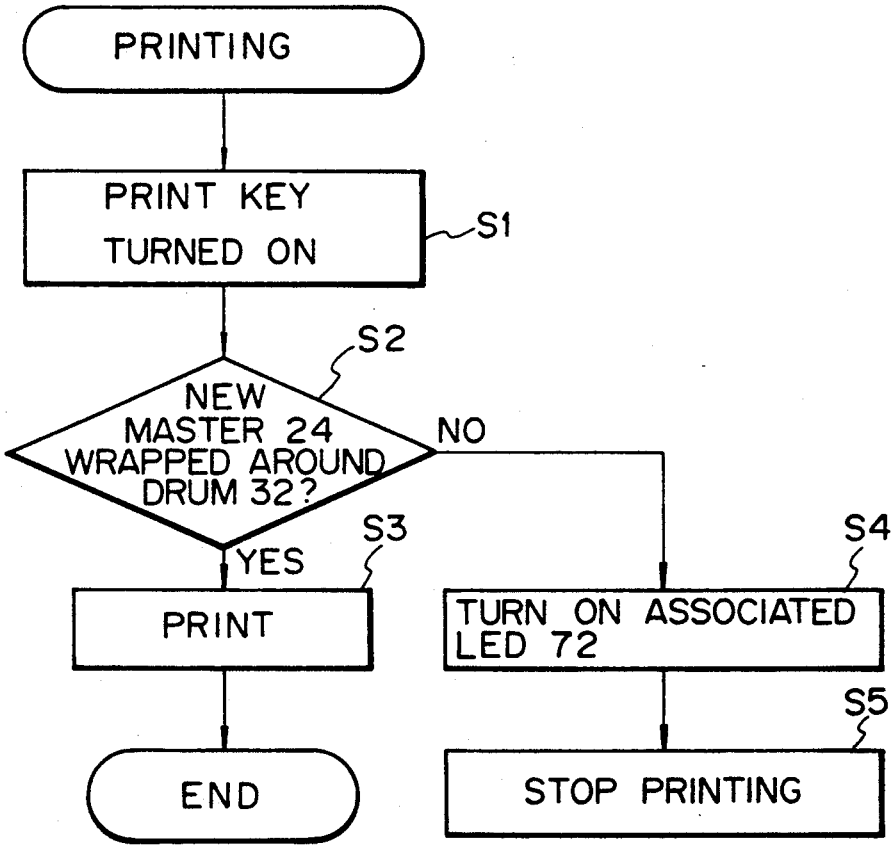
FIG. 8 is a flowchart demonstrating a specific printing process also executed by the embodiment.

FIGS. 7 and 8 demonstrate a specific master making process and a specific printing process, respectively. Specifically, the operator presses the master start key 62, FIG. 4, to select the master making process (step S1). The resulting output of the key 62 is fed to the control section 90. Whether or not a document is laid on the document reading section 10 is determined (S2). If the answer of the step S2 is YES, whether or not a used master sheet 24 is present on the drum 32 is determined (S3). If a used master sheet 24 is absent on the drum 32, the light issuing from the light emitting element of the photosensor 82, FIG. 6, is absorbed by the light absorbing section 32*c* and not reflected to the light-sensitive element, as stated earlier. If such a master sheet 24 is present on the drum 32, it reflects the light toward the light-sensitive element. This is successful in determining whether or not a master sheet 24 is present on the drum 32. On receiving the output of the key 62 and the output of the master sheet detecting section 80 indicative of the presence of a used master sheet 24, the control section 90 delivers a command to the discharging section 50 for causing it to perform a master discharging operation according to a predetermined program (S4). In response, the discharging section 50 removes the used master sheet 24 from the drum 32 and drives it out into the tray 54. Then, whether or not a used master sheet 24 is present on the drum 32 is determined again (S5). If the answer of the step S5 is NO, the control section 90 feeds a document read command and a master make command to the document reading section 10 and master making section 20, respectively. As a result, the thermal head 22 forms cuts 24*a* in a master sheet 24 in a pattern corresponding to a document image (S6). The master sheet 24 with cuts 24*a* is wrapped around the drum 32 (S7). When the discharging section 50 has failed to remove the used master sheet 24 from the drum 32 as determined in the step S5, the control section 90 again delivers a discharge command to the discharging section 50 (S8). Then, the master sheet detecting section 80 checks the drum 32 again to see if a master sheet 24 is present thereon (S9). If the answer of the step S9 is NO, meaning that the used master sheet 24 has been successfully removed, the operation advances to the step S6. If the used master sheet 24 still remains on the drum 32 as determined in the step S9, a particular LED 72 on the displaying section 70 flashes to inform the operator of such an error (S10), and the master making process is interrupted (S11). If a used master sheet 24 is absent on the drum 32 as determined in the step S3, the program jumps to the step S6 to enter into a master making operation immediately since the master discharging operation is not necessary.

Thereafter, the operator selects the printing process by pressing the print start key 64 on the operating section, FIG. 4, (S1). The resultant output of the key 64 is fed to the control section 90. Whether or not a new master sheet 24 is present on the drum 32 is determined (S2). If the answer of the step S2 is YES, the control section 80 feeds a print command to the printing section 30 for causing it to start on a printing operation (S3). If the answer of the step S2 is NO, a particular LED 72 on the displaying section 70 flashes to inform the operator of the absence of a new master sheet 24 (S4), and the printing process is interrupted (S5). At this instant, when the operator presses the master start key 62, the LED 72 will be turned off and the program will start on the master making procedure immediately by skipping the previously stated master discharging operation.

As stated above, when the master making process is selected, the control section 90 delivers a master discharge command to the discharging section 50 if the detecting section 80 detects a used master sheet 24 on the drum 32. After the discharge of the used master sheet 24, the control section 90 commands the master making section 20 to make a master if the detecting section 80 does not detect a used master sheet 24. On the other hand, when the printing process is selected, the control section 90 commands the printing section 30 to print out an image if the detecting section 80 detects a new master sheet 24 on the drum 32 or inhibits the it from performing a printing operation if otherwise.

The illustrative embodiment, therefore, prevents a paper sheet from wrapping around the drum 32 and therefore a new master from wrapping around a paper sheet on the drum 32 and prevents a new master sheet from wrapping around a used master sheet.

Second Embodiment

Figure 9:
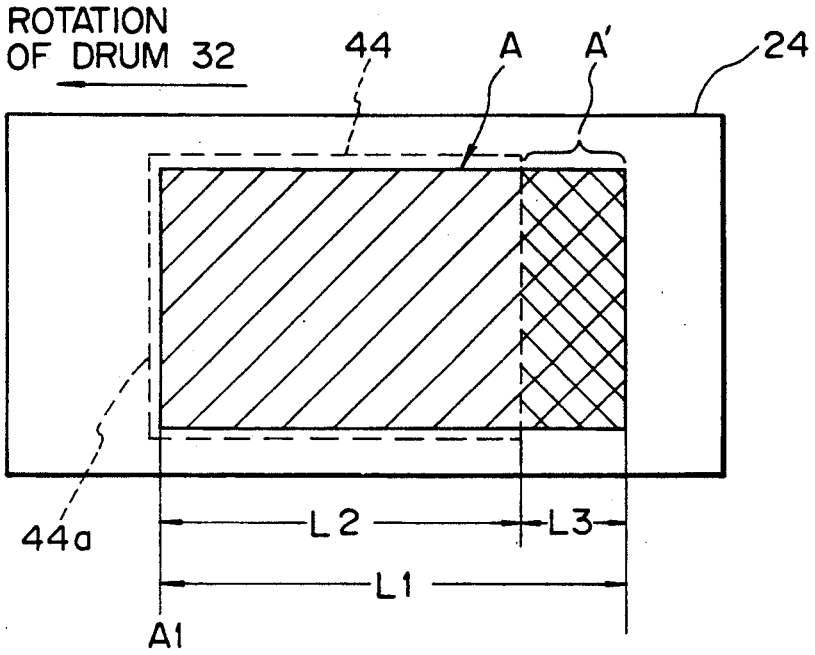
FIGS. 9 and 10 are views representative of a relation between the length of an image area of a master sheet wrapped around the drum of the printing section and the length of a paper sheet, particular to a second embodiment of the present invention.
Figure 10:
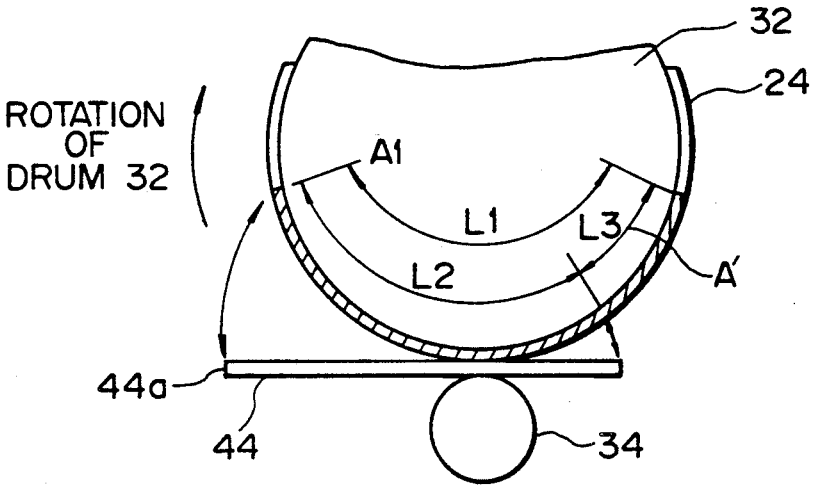

An alternative embodiment which will be described is directed toward the second object of the present invention stated earlier. As shown in FIGS. 9 and 10, it has been customary with the integrated stencil duplicating machine that the length L1 of the image area A of the master sheet 24 in which the cuts 24*a* are actually formed as measured in the rotating direction of the drum 32 is determined by a document size or a magnification change ratio. Assume that paper sheets 44 whose size L2 is smaller than an original document size or a document size undergone magnification change are stacked on the tray 42 of the paper feeding section 40, and that one of them is fed such that the leading edge 44*a* thereof substantially coincides with the leading edge A1 of the area A of the master sheet 24 which is wrapped around the drum 32, as shown in FIGS. 9 and 10. Then, a part A' of the image area A having a length L3 protrudes from the paper sheet 44 and is printed out on the surface of the press roller 34, smearing the press roller 34. Moreover, as the next paper sheet 44 is fed from paper feeding section 40, the image unwantedly printed out on the press roller 34 is transferred to the back of the paper sheet 44. This is repeated until a present number of duplicates have been produced by the master sheet 24.

Figure 11:
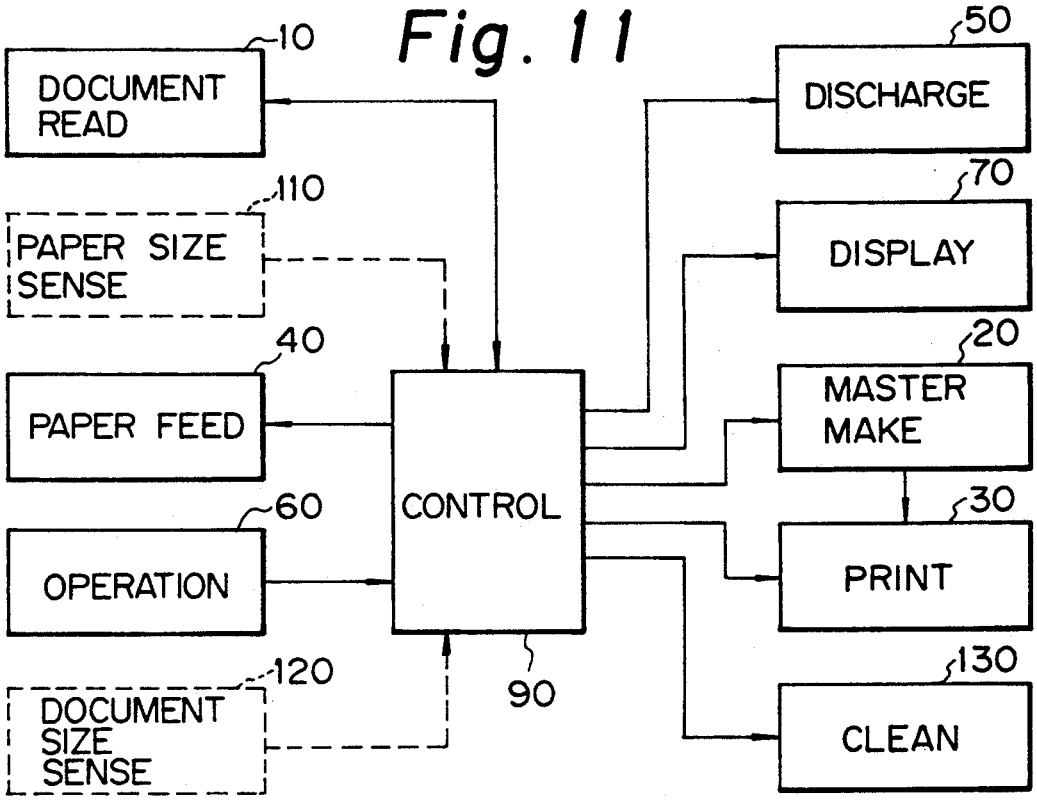
FIG. 11 is a block diagram showing the construction of the second embodiment.

In this embodiment, when the paper feeding section 40 is not loaded with paper sheets 44 of the size matching an original document size or a document size undergone magnification change, an image is formed only in a particular part of the image area A of the master sheet 24 which matches the sensed paper size. This prevents the remaining part A' of the image area A from being printed out on the press roller 34. Specifically, as shown in FIG. 11, the control device has a paper size sensing section 110 responsive to the size of paper sheets 44 stacked on the tray 42 of the paper feeding section 40.

Figure 12:
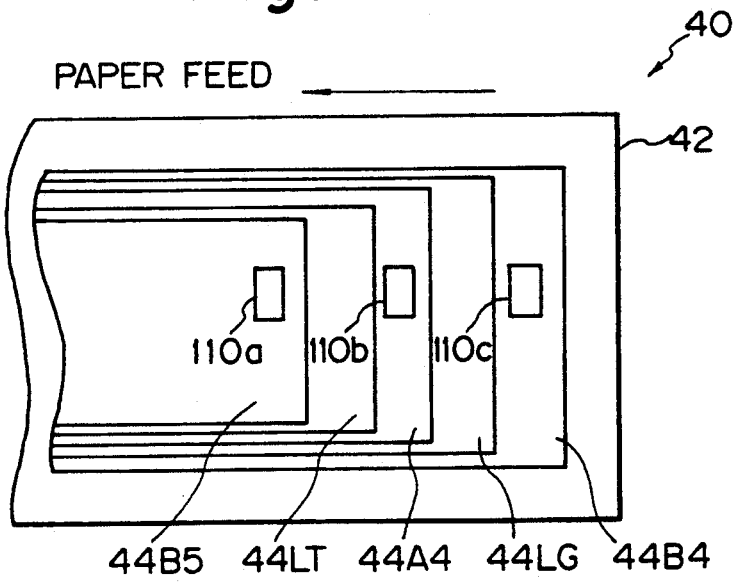
FIG. 12 is a view showing a specific construction of a paper size detecting section included in the second embodiment.

As shown in FIG. 12, a circuit board carrying three reflection type photosensors 110*a*, 110*b* and 110*c* are provided on the upper surface of the tray 42 of the paper feeding section 40. The photosensors 110*a* to 110*c* each comprises a light emitting element and a light-sensitive element. Paper sheets of a particular size are stacked on the circuit board and positioned in the lengthwise direction by a reference, not shown, which is shared by paper sheets of the other sizes also. Ranges in which paper sheets of different sizes should be positioned are marked on the substrate, as illustrated. Specifically, paper sheets 44B5, 44LT, 44A4, 44LG and 44B4 are representative of size B5, letter size, size A4, legal size, and size B4, respectively. The photosensor 110*a* is located in the range for accommodating the paper sheets 44B5, i.e., such that light issuing from the light emitting element thereof is reflected by the paper sheets 44B5 stacked on the tray 42 to reach the associated light-sensitive element. Likewise, the photosensor 110*b* is located in the range assigned to the paper sheets 44A4 and outside of the range assigned to the paper sheets 44LT, while the photosensor 110*c* is located in the range assigned to the paper sheets 44B4 and outside of the range assigned to the paper sheets 44LG. The photosensors 110*a* to 110*c* constitute the paper size sensing section 110.

Figure 13:
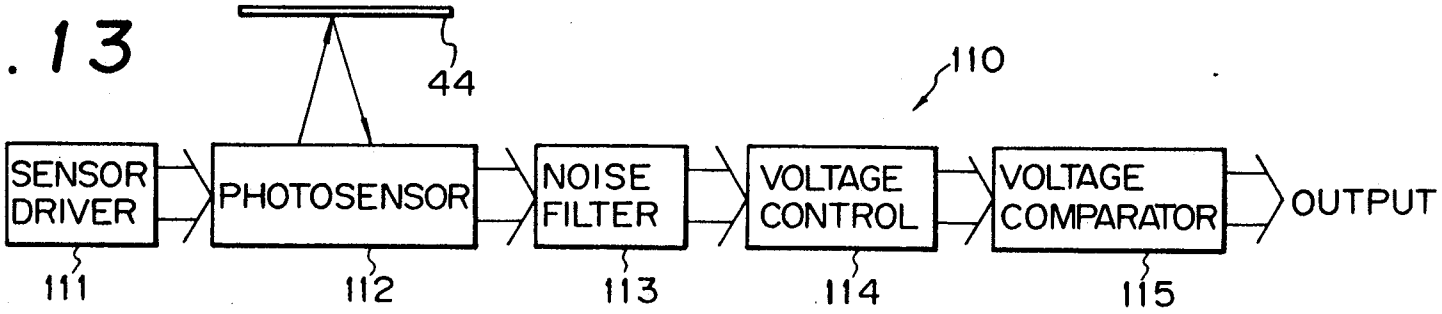
FIG. 13 is a block diagram schematically showing a specific construction of a paper size detecting section included in the embodiment of FIG. 11.

FIG. 13 shows a specific construction of the paper size sensing section 110. As shown, the paper size sensing section 110 has a photosensor driver 111 for causing the photosensors 110*a*, 110*b* and 110*c* to emit light. A photosensor 112 is representative of the photosensors 110*a* to 110*c* and driven by the sensor driver 11 to generate a voltage signal associated with light incident to the light-sensitive element. A noise filter 113 filters out noise included in the output signal of the photosensor 112. A voltage amplifier 114 amplifies the output voltage of the noise filter 113. A voltage comparator 115 compares the output of the voltage amplifier 114 with a reference voltage and, if the former is higher than the latter, outputs a detection signal determining that a sufficient amount of light is incident to the light-sensitive element. In this configuration, the size of paper sheets stacked on the tray 42 of the paper feeding section can be determined on the basis of the combination of the outputs (ON-OFF) of the photosensors 110*a* to 110*c*, as shown in Table 1 below.

TABLE 1

| SENSOR 110a | SENSOR 110b | SENSOR 110c | PAPER |
|---|---|---|---|
| ON | OFF | OFF | 44B5 |
| ON | ON | OFF | 44A4 |
| ON | ON | ON | 44B4 |
| ON | OFF | OFF | 44LT |
| ON | ON | ON | 44LG |

The detection signal from the paper size sensing section 110 is applied to the control section 90. In response, the control section 90 delivers a command to the master making section 20 for causing it to match the length L1 of the image area A of a master sheet 24 to the sensed size of the paper sheets 44. Then, the master making section 20 drives the thermal head 22 for a predetermined period of time associated with the paper size, thereby forming cuts in the master sheet 24. Since the paper sheets have regular sizes without exception, the widthwise dimension is automatically determined by the lengthwise direction. Parts of the image area A of the master sheet 24 which will protrude sideways from a paper sheet are masked by the master making section 20 in response to a command from the control section 90. However, even if an image is cut in the widthwise or sideways parts of the image area A and printed on the press roller 34, it is prevented from being transferred to the back of a paper sheet since the paper sheet does not contact the corresponding sideways or widthwise parts of the roller.

From the foregoing it should be apparent that no image is formed in those portions of a master sheet 24 which protrude from a paper sheet. Hence, even when this kind of master sheet 24 is wrapped around the drum 32, the image lying in the protruding parts of the sheet 24 is prevented from being printed out on the press roller 34 and thereby transferred to the back of a paper sheet.

Figure 14:
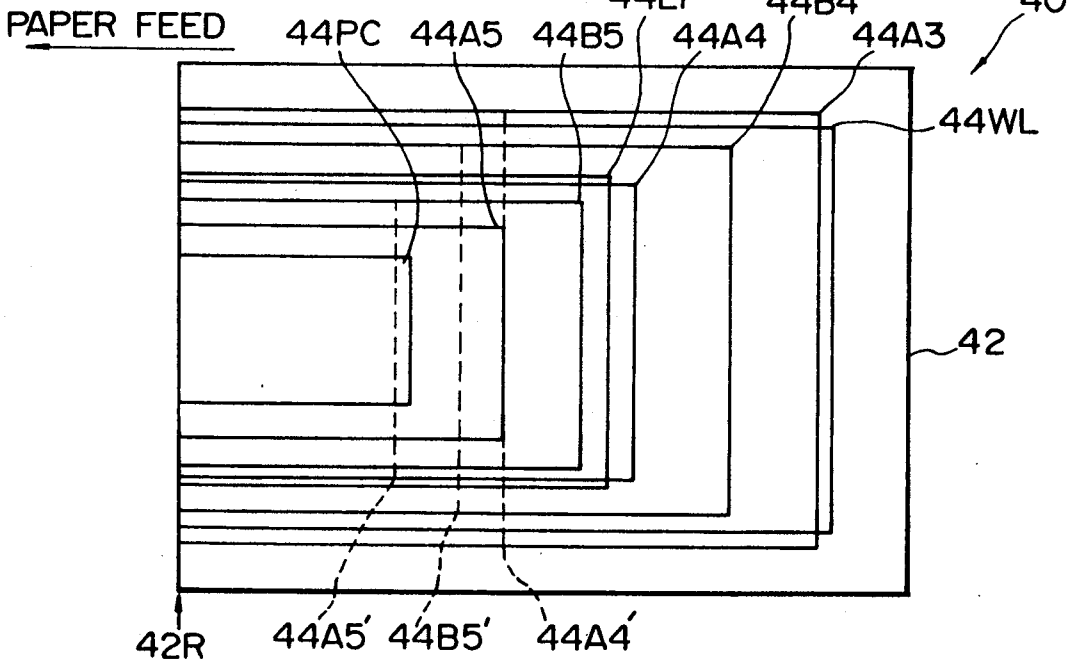
FIG. 14 is a plan view showing paper sheets of various sizes which may be stacked in a paper feeding section.
Figure 15:
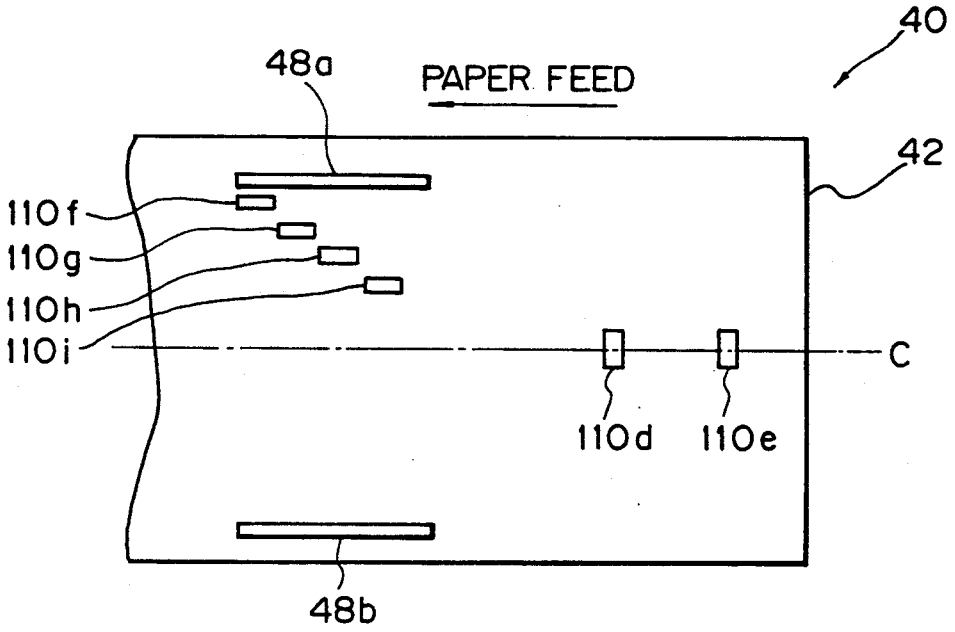
FIGS. 15 and 16 are block diagrams showing another specific construction of the paper size detecting section.
Figure 16:
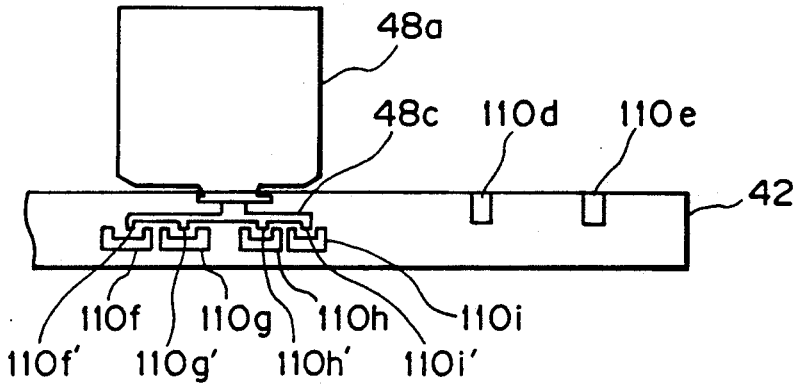

Referring to FIG. 14, a modified form of the paper size sensing section 110 will be described. As shown, the modified paper size sensing section 110 is capable of sensing paper sheets of various sizes which may be stacked on the tray 42 with the leading edges thereof located at a reference position 42R. Specifically, there are shown in FIG. 14 paper sheets 44WL of double letter size, paper sheets 44A3 of size A3, paper sheets 44B4 of size B4, paper sheets 44A4 of size A4, paper sheets 44LT of letter size, paper sheets 44B5 of size B5, paper sheets 44A5 of size A5, and paper sizes 44PC of post card size which are so positioned as to be fed lengthwise, and paper sheets 44A4' of size A4, paper sheets 44B5' of size B5, and paper sheets 44A5' of size A5 which are so positioned as to be fed widthwise. To sense such eleven different paper sizes in total, as shown in FIGS. 15 and 16, the modified paper size sensing section 110 has Photosensors 110*d*, 110*e*, 110*f*, 110*g*, 110*h* and 110*i* each comprising a light emitting element and a light-sensitive element. The photosensor 110*d* assumes a position where it goes ON by sensing the paper sheets 44A5 and goes OFF by not sensing the paper sheets 44B5'. Likewise, the photosensor 110*e* goes ON by sensing the paper sheets 44B5 and goes OFF by not sensing the paper sheets 44A5. As also shown in FIGS. 15 and 16, a pair of side plates 48*a* and 48*b* are provided on the tray 42 and movable toward and away from each other in interlocked relation. Specifically, the side plates 48*a* and 48*b* each is movable toward and away from the widthwise center C of the tray 42. As shown in FIG. 16, the side plate 48*a*, for example, has a stay 48*c* which is movable integrally with the side plate 48*a* and is provided with four lugs 110'*f*, 110'*g*, 110'*h* and 110'*i*. The lugs 110'*f* to 110'*i* of the stay 48*c* are arranged to intercept, while the stay 48*c* is in movement, light issuing from the light emitting elements of the photosensors 110*f* to 110*i*. The photosensors 110*f* and 110*i* are held in a positional relation shown in FIG. 15. In this configuration, the photosensors 110*f* to 110*i* each goes ON or OFF depending on the position where the side plate 48*a* is stopped, i.e., the paper size. The paper size sensing section 110, therefore, senses any one of eleven different paper sizes on the basis of the combination of the outputs of the photosensors 110*d* to 11*i*, as shown in Table 2 below.

TABLE 2

| SENSOR 110f | SENSOR 110g | SENSOR 110h | SENSOR 110i | SENSOR 110d | SENSOR 110e | PAPER |
|---|---|---|---|---|---|---|
| ON | OFF | OFF | OFF | ON | ON | 44A3 |
| OFF | ON | OFF | OFF | ON | ON | 44WL |
| ON | ON | ON | OFF | ON | ON | 44B4 |
| OFF | OFF | ON | OFF | ON | ON | 44LT |
| OFF | OFF | ON | ON | ON | ON | 44A4 |
| ON | ON | ON | ON | ON | ON | 44B5 |
| OFF | ON | OFF | ON | ON | ON | 44A5 |
| ON | OFF | OFF | ON | OFF | OFF | 44PC |
| ON | OFF | OFF | OFF | ON | OFF | 44A5' |
| ON | ON | ON | OFF | OFF | OFF | 44B5' |
| OFF | OFF | ON | ON | OFF | OFF | 44A5' |

Usually, paper sheets 44 whose size matches the size of a document are stacked on the tray 42 of the paper feeding section 40. Hence, the illustrative embodiment effects the control when paper sheets 44 different in size from a document are inadvertently loaded on the tray 42. However, in a magnification change mode operation, the operator is apt to load the tray 42 with paper sheets which do not match the document size or the processed image size. It is therefore preferable to urge the operator to confirm the size of paper sheets stacked on the tray 42 in the event of a magnification change mode operation, especially at the time of enlargement. This may be implemented with the following arrangement. Specifically, a document size sensing section 120, FIG. 11, automatically senses the size a document laid on the platen of the document reading section 10. The control section 90 determines an adequate paper size on the basis of the sensed document size and the desired magnification change ratio. If the paper size sensed by the sensing section 110 does not agree with the adequate paper size, the control section 90 delivers an alarm signal to the displaying section 70 to display a message thereon. In this condition, even when the operator presses the master start key 62 on the operating section 60, the control section 90 inhibits the master making section 20 from performing the expected operation thereof. Consequently, neither the plate making process nor the printing process is executed in inadequate conditions, whereby the press roller 34 is free from smears and eliminates the transfer of the smears to the back of a paper sheet. The document size sensing means 120 may be constructed in the same manner as any one of the paper size sensing sections 110 described previously.

Assume that the operator presses the master start key 62 despite that the master making and printing operations have been inhibited due to the mismatch of the sensed paper size and the sensed document size and calculated adequate paper size. Then, the control section 90 delivers a command to the plate making section 20 for causing it to form an image pattern in a master sheet 24 by a magnification change ratio which matches the sensed paper size. In response, the master making section 20 changes the magnification of an image automatically and then causes the thermal head 22 thereof to form the resultant image in the master sheet 24. While the magnification of the resulted image will be different from the desired magnification, the image is prevented from being partly lost on a duplicate and, of course, the press roller 34 and paper sheets 44 are free from smears.

Third Embodiment

The second embodiment described above senses the size of paper sheets 44 and performs control such that an image is not formed in the part A', FIGS. 9 and 10, of the master sheet 24 which protrudes from the image area A corresponding to the paper size, thereby freeing the press roller 34 from smears. While a third embodiment which will be described senses the paper size in the same manner as the second embodiment, it presses the press roller 34 against the drum 32 only during a period of time associated with the sensed paper size, i.e., the the length of a paper sheet 44 as measured in the intended direction of paper transport. As soon as the paper sheet 4 moves away from the drum 34, the press roller 34 is immediately released from the drum 32 and cleaned by a cleaning device. This is also successful in preventing the press roller 34 and, therefore, the paper sheet 44 from being smeared.

Figure 17:
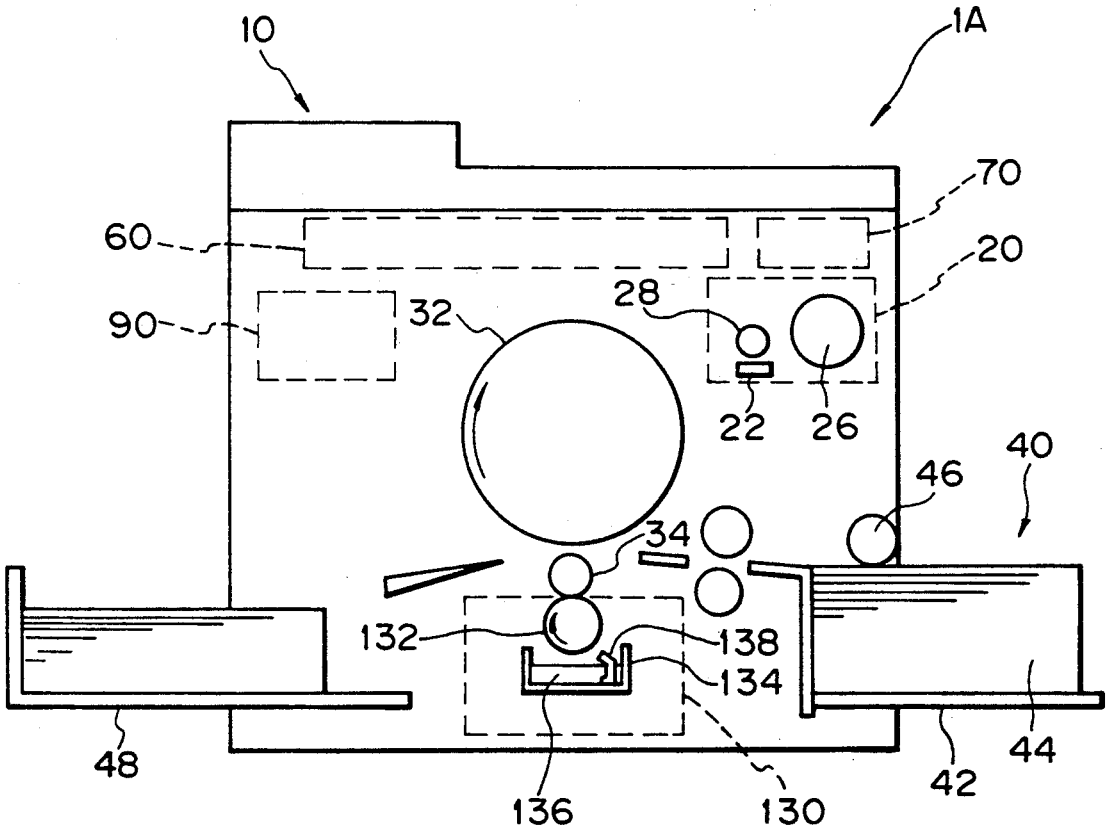
FIG. 17 is a view showing a stencil duplicating machine implemented with a third embodiment of the present invention.

Referring to FIG. 17, a stencil printing machine 1A implemented with the third embodiment is shown. As shown, a cleaning section 130 is located below the press roller 34. The rest of the construction is the same as the second embodiment. The cleaning section 130 has a cleaning roller 132 which is rotatable in contact with the press roller 34 and thereby cleans it when the latter is brought out of contact with the drum 32. A reservoir 134 stores a cleaning liquid 136. A nozzle 138 jets the cleaning liquid 136 toward the cleaning roller 132. After a master sheet 24 produced by the master making section 20 has been wrapped around the drum 32, the press roller 34 is caused into pressing contact with the drum 32 with the intermediary of a paper sheet 44 in response to a print command entered on the print start key 64. On receiving the print command, the control section 90 delivers a clean command to the cleaning section 130. In response, the cleaning section 130 rotates the cleaning roller 132 and causes the nozzle 138 to jet the liquid 136 at predetermined intervals, thereby wetting the cleaning roller 132. An excessive part of the liquid 136 is returned to the reservoir 134 to be reused. The size of paper sheets 44 loaded in the paper feeding section 40 is constantly sensed, as in the second embodiment. A signal representative of the sensed paper size holds the press roller 34 in contact with the drum 32 during a period of time associated with the paper size, i.e., until the entire length of the paper sheet 4 as measured in the paper transport direction moves away from the press roller. During the other period, the press roller 34 is lowered away from drum 32 into contact with the cleaning roller 132. Then, the cleaning roller 132 wet with the cleaning liquid 136 removes the ink from the press roller 34.

In summary, when paper sheets 44 stacked on the tray 42 of the paper feeding section 40 is not of the size matching the size of a document or the size of a reduced or enlarged image to be produced, the second and third embodiments each senses the size of the paper sheets 44 automatically by the sensing section 110 and forms a pattern only in the image area A over the length L2 which matches the paper size. As a result, the press roller 34 and, therefore, the paper sheets 44 is freed from smears during the printing process.

Various modifications will become possible for those skilled in the art after receiving the teachings of the present disclosure without departing from the scope thereof.

What is claimed is:

1. A control device for a stencil dupliating machine for selectively executing, in response to a command entered on an operating section, a master making process in which a used master sheet wrapped around a drum in a printing section is removed and discharged by a discharging section and then a new master sheet produced by a master making section is wrapped around said drum, and a printing process in which said printing section prints out an image formed in said new master sheet wrapped around said drum on a paper sheet fed from a paper feeding section, said control device comprising:

master sheet detecting means for determining whether or not the used master sheet or the new master sheet is present on said drum; and control means for controlling, in response to the command entered on said operating section, said printing section, said discharging section, said master making section and said paper feeding section such that when said master sheet detecting means detects the new master sheet on said drum, the printing process is executed while, when said master sheet detecting means does not detect said new master sheet, said printing process is inhibited, and such that when said master sheet detecting means detects a used master sheet on said drum, the master making process is not executed while, when said master sheet detecting means does not detect a used master sheet on said drum, the master making section is executed.

2. A control device as claimed in claim 1, wherein in the event of the master making process said control means commands, when said master sheet detecting means detects the used master sheet on the drum, said discharge section to perform a discharging operation and commands, when said master sheet detecting means does not detect said used master sheet after said discharging operation, said master making section to perform a master making operation.

* * * * *